US010888186B2

(12) United States Patent
Pepper

(10) Patent No.: US 10,888,186 B2
(45) **Date of Patent: *Jan. 12, 2021**

(54) FOLDABLE REUSABLE CHOPSTICKS AND STORAGE CASE

(71) Applicant: THE FINAL CO. LLC, Santa Fe, NM (US)

(72) Inventor: Miles Pepper, Los Angeles, CA (US)

(73) Assignee: THE FINAL CO. LLC, Santa Fe, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/431,470

(22) Filed: Jun. 4, 2019

(65) Prior Publication Data

US 2019/0365129 A1 Dec. 5, 2019

Related U.S. Application Data

(60) Provisional application No. 62/680,246, filed on Jun. 4, 2018.

(51) Int. Cl.

| | |
|---|---|
| ***A47G 21/06*** | (2006.01) |
| ***B65D 43/16*** | (2006.01) |
| ***B65D 25/04*** | (2006.01) |

(52) U.S. Cl.

CPC ..... *A47G 21/103* (2013.01); *B65D 25/04* (2013.01); *B65D 43/163* (2013.01)

(58) Field of Classification Search

CPC .... A47G 21/103; B08B 1/005; B08B 9/0436; A47L 17/00; B65D 81/261; B65D 43/163;

(Continued)

(56) References Cited

U.S. PATENT DOCUMENTS 942,306 A 12/1909 Clarke
2,815,981 A 12/1957 Nonnamaker et al.

(Continued)

FOREIGN PATENT DOCUMENTS

JP 200899857 A * 10/2006
JP 2014-155524 A 8/2014

(Continued)

OTHER PUBLICATIONS

U.S. Appl. No. 16/186,560, filed Nov. 11, 2018, Pepper, Miles.

(Continued)

*Primary Examiner* — Stephen A Vu

(74) *Attorney, Agent, or Firm* — Marshall, Gerstein & Borun LLP

(57) ABSTRACT

Reusable chopsticks that are foldable into a compact configuration for storage and easily transportable in a storage case. The chopsticks each comprise a rigid external structure and at least one flexible internal member that is foldable to a compact configuration for storage. In a folded configuration, the reusable chopsticks have a significantly reduced length of approximately one-half to one-fourth of their extended length when in use. The external structure of the chopstick is preferably formed of multiple rigid segments connected by the flexible internal member(s) in the extended configuration during use as chopsticks. A storage case is provided to store the chopsticks in the folded configuration in a compact form.

23 Claims, 6 Drawing Sheets

(58) Field of Classification Search
CPC ..... B65D 25/04; B27K 9/007; A61G 1/013; B60J 7/0076
USPC ..... 294/218
See application file for complete search history.

(56) References Cited

U.S. PATENT DOCUMENTS

| | | | | |
|---|---|---|---|---|
| 3,025,004 | A * | 3/1962 | Levi | A47G 21/186 239/33 |
| 3,615,595 | A | 10/1971 | Guttag | |
| 3,776,458 | A | 12/1973 | Chunga, Sr. | |
| 4,109,817 | A | 8/1978 | Payne et al. | |
| 4,340,175 | A | 7/1982 | Danek et al. | |
| 4,850,533 | A | 7/1989 | Hoshi et al. | |
| 4,930,652 | A | 6/1990 | Murphy et al. | |
| 5,094,861 | A | 3/1992 | D'Auguste et al. | |
| 5,172,827 | A | 12/1992 | Chang et al. | |
| 5,201,460 | A | 4/1993 | Caines | |
| 5,482,202 | A | 1/1996 | Wen | |
| D371,269 | S | 7/1996 | Shattuck et al. | |
| 5,727,734 | A | 3/1998 | Su | |
| D408,886 | S | 4/1999 | Matyushin et al. | |
| 6,283,294 | B1 | 9/2001 | Thorball et al. | |
| 6,460,777 | B2 | 10/2002 | Float et al. | |
| 6,676,032 | B2 | 1/2004 | Banach | |
| D487,375 | S | 3/2004 | Bengtsson et al. | |
| 7,093,868 | B1 * | 8/2006 | Shen | A47G 21/103 294/218 |
| D575,570 | S | 8/2008 | Antonelli | |
| D602,726 | S | 10/2009 | Baron | |
| D614,346 | S | 4/2010 | Lik | |
| 7,753,284 | B1 | 7/2010 | Raitses | |
| 7,823,802 | B1 | 11/2010 | Roche et al. | |
| D674,649 | S | 1/2013 | Ludwig et al. | |
| 8,459,484 | B2 | 6/2013 | Ravelo | |
| 8,579,148 | B2 | 11/2013 | Slansky | |
| D719,388 | S | 12/2014 | Ecseri | |
| 8,904,820 | B2 * | 12/2014 | Chen | A47G 21/02 294/218 |
| D726,477 | S | 4/2015 | Buck | |
| D728,154 | S | 4/2015 | Lavanchy et al. | |
| D749,884 | S | 2/2016 | Martins | |
| D755,440 | S | 5/2016 | Collen | |
| D757,476 | S | 5/2016 | O'Neill | |
| D762,408 | S | 8/2016 | Palazzi | |
| D772,632 | S | 11/2016 | Buck | |
| D778,492 | S | 2/2017 | Liu | |
| D798,095 | S | 9/2017 | Palazzi | |
| D808,580 | S | 1/2018 | Kwitel et al. | |
| D812,807 | S | 3/2018 | Thuery | |
| D813,445 | S | 3/2018 | Scott | |
| D815,479 | S | 4/2018 | Scardino et al. | |
| D819,264 | S | 5/2018 | Mykhaylovych | |
| D825,837 | S | 8/2018 | Abroff et al. | |
| D825,838 | S | 8/2018 | Abroff et al. | |
| D827,920 | S | 9/2018 | Fornarelli | |
| D828,623 | S | 9/2018 | Fornarelli | |
| D831,397 | S | 10/2018 | Diorio et al. | |
| 10,092,713 | B2 | 10/2018 | Terry et al. | |
| 10,123,641 | B1 | 11/2018 | Pepper | |
| 10,136,672 | B2 | 11/2018 | Minskoff et al. | |
| 10,159,278 | B2 | 12/2018 | Minskoff et al. | |
| 10,159,369 | B2 | 12/2018 | MacDonald | |
| D841,231 | S | 2/2019 | Hawes et al. | |
| D844,221 | S | 3/2019 | Tucker et al. | |
| D846,327 | S | 4/2019 | Peterson | |
| D847,568 | S | 5/2019 | Hartnett | |
| D853,164 | S | 7/2019 | Pepper | |
| D866,235 | S | 11/2019 | Pepper | |
| 2002/0030115 | A1 | 3/2002 | Float et al. | |
| 2002/0088870 | A1 | 7/2002 | Banach | |
| 2006/0060556 | A1 | 3/2006 | Lee | |
| 2006/0254604 | A1 | 11/2006 | Martinez Fernandez | |
| 2008/0169356 | A1 | 7/2008 | Trejo | |
| 2009/0283608 | A1 * | 11/2009 | Crawley | A47G 21/18 239/33 |
| 2011/0057050 | A1 | 3/2011 | Shakur-Jenkins | |
| 2012/0068487 | A1 * | 3/2012 | Wong | A47G 21/103 294/218 |
| 2012/0138622 | A1 | 6/2012 | Slansky | |
| 2013/0270357 | A1 | 10/2013 | Anderson | |
| 2014/0013880 | A1 | 1/2014 | Nikolaizig | |
| 2014/0231535 | A1 | 8/2014 | Alotaibi | |
| 2014/0246445 | A1 * | 9/2014 | Lee | A47L 19/04 220/666 |
| 2014/0339325 | A1 * | 11/2014 | Williams | A47G 21/186 239/33 |
| 2014/0339819 | A1 | 11/2014 | Baker | |
| 2015/0190004 | A1 | 7/2015 | Chang et al. | |
| 2015/0313390 | A1 | 11/2015 | Russo et al. | |
| 2016/0051071 | A1 | 2/2016 | Buck | |
| 2016/0338406 | A1 | 11/2016 | Liu | |
| 2017/0150754 | A1 | 6/2017 | Lin | |
| 2018/0235390 | A1 | 8/2018 | Lehmann | |
| 2019/0059624 | A1 | 2/2019 | Kazmierczak, III et al. | |
| 2019/0069701 | A1 | 3/2019 | O'Neill | |
| 2019/0082815 | A1 | 3/2019 | Chen | |
| 2019/0099025 | A1 | 4/2019 | Rieger | |

FOREIGN PATENT DOCUMENTS

| | | | |
|---|---|---|---|
| KR | 20090098400 | A | 9/2009 |
| KR | 20090108259 | A | 10/2009 |
| KR | 20100128648 | A | 12/2010 |
| KR | 20130091922 | A | 8/2013 |

OTHER PUBLICATIONS

U.S. Appl. No. 29/648,754, filed May 23, 2018, Pepper, Miles.
U.S. Appl. No. 29/654,245, filed Jun. 2018, Pepper, Miles.
U.S. Appl. No. 29/661,212, filed Aug. 2018, Pepper, Miles.
U.S. Appl. No. 29/664,367, filed Sep. 2018, Pepper, Miles.
U.S. Appl. No. 29/665,794, filed Oct. 2018, Pepper, Miles.
U.S. Appl. No. 29/701,902, filed Aug. 15, 2019, Pepper, Miles.
Alibaba.com, Everich collapsible stainless steel straw, Publication date unknown, [site visited May 7, 2019], Available on the Internet URL https://www.alibaba.com/product-detail/collapsible-stainless-stee1-304-silicone-straw 62016062697.htnnl?spnn=a2700.galleryofferlist.nornnalList.124.6e7cf7eawdAolW (Year: 2019).
Amazon.com, Collapsible straw Divine Domicile, Publication date Mar. 2019, [site visited Mar. 6, 2019], Available on the Internet URL https://www.annazon.conn/collapsible-straw-Divine-Domicile-stainless/dp/B07R1Y8JD2/ref=sr_1_fkmrnull_1_?keywords=straw%2Bdivine%2Bdonnicile&gid=1557249520&s=gat (Year: 2019).
Amazon.com, FinalStraw—Original—Patented—Real Simple, Shark Tank, Kickstarter, Publication date Mar. 2019, [site visited May 7, 2019], Available on the Internet URL https://www.annazon.conn/dp/B07KRRGPV4/ref=psdc_16439911_t1_BO7KT8XBSS (Year: 2019).
Amazon.com, Hydreann straw1 Collapsible Reusable Stainless Steel, Publication date Aug. 20, 2018, [site visited Jan. 29, 2019], Available on the Internet URL https://www.annazon.conn/Hydreann-Collapsible-Reusable-Stainless-Food-Grade/dp/B07GNZKKDK/_ref=cnn_cr_arp_d_producttop?ie=UTF8.
FinalStraw.com, FinalStraw, Earliest publication date Aug. 2018 from Internet Archive, [site visited May 7, 2019], Available on the Internet URL https://web.archive.org/web/20180803173948/https://finalstraw.conn/ (Year: 2019).
International Search Report for PCT/US18/35621 dated Aug. 29, 2018.
Walmart.com, Collapsible Reusable Straws with Case Holder, Publication date unknown, [site visited Jan. 29, 2019], Available on the Internet URL https://www.walmart.com/ip/_Collapsible-Reusable-Straws-Case-Holder-Keychain-Portable-Collapsible-Foldable-Stainless-Steel-Snnoothie-Drinkinp-Metal-Tunnb_ler-Straws-Cleaning-Brus.

* cited by examiner

FOLDABLE REUSABLE CHOPSTICKS AND STORAGE CASE

The present application claims the benefit of Provisional Application No. 62/680,246 filed Jun. 4, 2018, incorporated by reference herein.

BACKGROUND OF THE INVENTION

Single-use eating utensils, such as chopsticks, are detrimental to the environment due to over-utilization of resources and the unnecessary generation of waste. For example, China uses approximately 20 million trees each year to supply China's demand for disposable, single-use chopsticks. At approximately 4,000 chopsticks per tree, that is roughly 80 billion chopsticks per year. Greenpeace has dedicated a campaign to the chopstick problem, blaming it for the destruction of 1.18 million square meters of forest every year.

The problems caused by reusable chopsticks are well recognized. As set forth by Erica Lee in DES 40A Winter 2018 University of California, Davis—Department of Design (http://www.designlife-cycle.com/disposable-chopsticks/), reproduced in part below:

Disposable wooden chopsticks, a staple utensil at Asian restaurants throughout the world, are often tossed in the trash without second thought. These seemingly harmless wooden sticks, treated with multiple chemicals and thus making them not biodegradable, take up a great deal of space in landfills. These disposable wooden chopsticks generate tons of waste in the duration of their life cycle, from their inception, to their transportation, and to the end of their lives. Although alternative methods to reuse wooden chopsticks have been devised, they still produce waste and it will be a while before these methods are implemented on a larger scale.

In addition to the carbon dioxide emissions from the machinery used to manufacture single-use chopsticks, the chemical processing of the wooden chopsticks produces hazardous chemical waste. Generally, the wooden chopsticks are bathed in a solution of different chemical compounds, but the most common ingredient used is sulfur dioxide (Nuwer, Rachel. "Disposable Chopsticks Strip Asian Forests." The New York Times, 24 Oct. 2011, green-.blogs.nytimes.com/2011/10/24/disposable-chopsticks-strip-asian-forests/. "Nuwer").

Transportation of disposable wooden chopsticks from factory to restaurants around and across the Pacific has its economic benefits, but the thousands of miles traveled has its effect on the environment. Chinese-made disposable chopsticks are both consumed in China and exported to Japan, Korea, and the United States (Nuwer). Arguably, the transportation of the chopsticks produces the largest amount of waste in the whole lifecycle of a pair of disposable chopsticks due to the sheer millions of tons of exhaust from cargo ships and trucks.

Once used, disposable wooden chopsticks are thrown away and placed into landfills. Since wooden chopsticks are bleached and treated with the chemical bath, they are not compostable. When wooden chopsticks are discarded, they end up in landfills and eventually biodegrade over a few decades. China goes through roughly forty-five billion pairs of disposable wooden chopsticks a year, while the international market goes through over eighteen billion pairs of the wooden chopsticks. Over ninety percent of these wooden chopsticks end up in landfills around the world (Gardner, Daniel K. "China's fight against disposable chopsticks." Los Angeles Times, Los Angeles Times, 15 Aug. 2010, articles.latimes.com/2010/aug/15/opinion/la-oe-0815-gardner-chopsticks-20100815. "Gardner").

One solution to not using wooden chopsticks is for people to carry their own, reusable chopsticks. But the problem is that reusable chopsticks are often made out of metal or plastic, and by nature are long and inconvenient to carry around. If people are to bring reusable chopsticks everywhere, they will want somewhere clean to put the reusable chopsticks. That means keeping the reusable chopsticks in a case that is even bigger and bulkier than the reusable chopsticks in their current form.

Therefore, there exists a need for convenient, reusable chopsticks that are easy to carry, store, and easy to clean.

SUMMARY OF THE INVENTION

The present invention is directed to reusable chopsticks that are foldable into a compact configuration for storage and are easily transportable in a storage case. The chopsticks each comprise a rigid external structure and at least one flexible internal member that permits the external structure of the chopstick to be foldable along segments to a compact configuration for storage. In a folded configuration, the reusable chopsticks have a significantly reduced length of approximately one-half to one-fourth or less of their extended length when in use. The external structure of the chopstick is preferably formed of multiple rigid segments, each segment preferably being connected to at least another one of such segments by the flexible internal member(s). In the extended configuration, the rigid segments connect to form the rigid external structure to maintain configuration of the chopstick suitable for use during eating without collapsing. After use, the chopstick can be folded into the compact configuration for storage. A storage case is provided to store the chopsticks in the folded configuration in a compact form. The chopsticks of the present invention are collapsible chopsticks that self-assemble.

The chopsticks are in an extended configuration preferably when at least two of the segments are coupled together with the flexible internal member to form the rigid external structure of the chopstick. In a preferred embodiment, the coupling of the segments to one another via reciprocal interdigitating ends, such as with male and female configured ends, form a rigid structure once assembled. The flexible internal member being under tension within the chopstick to maintain the segments coupled together. The elastic nature of flexible internal member, returning from a stretched state in the folded configuration to a less-stretched state in the extended configuration, functions to essentially automatically extend and reconfigure the chopstick to the extended configuration.

The chopstick is in a folded configuration preferably when at least two of the segments are uncoupled from one another and moved apart by stretching the flexible internal member connecting the at least two segments and folding the flexible internal member between at least two segments.

The present invention provides a convenient reusable chopsticks that are easy to carry and store.

These and other objects of the present invention will be apparent from review of the following specification and the accompanying drawings.

BRIEF DESCRIPTION OF THE DRAWINGS

The accompanying drawings, which are included to provide further understanding of the present invention disclosed in the present disclosure and are incorporated in and constitute a part of this specification, illustrate aspects of the present invention and together with the description serve to explain the principles of the present invention. In the drawings.

DETAILED DESCRIPTION OF THE PREFERRED EMBODIMENT

The detailed description set forth below is intended as a description of various configurations of the present invention and is not intended to represent the only configurations in which the present invention may be practiced. It will be apparent, however, to those of ordinary skill in the art that the present invention is not limited to the specific details set forth herein and may be practiced without these specific details.

Figure 1A:
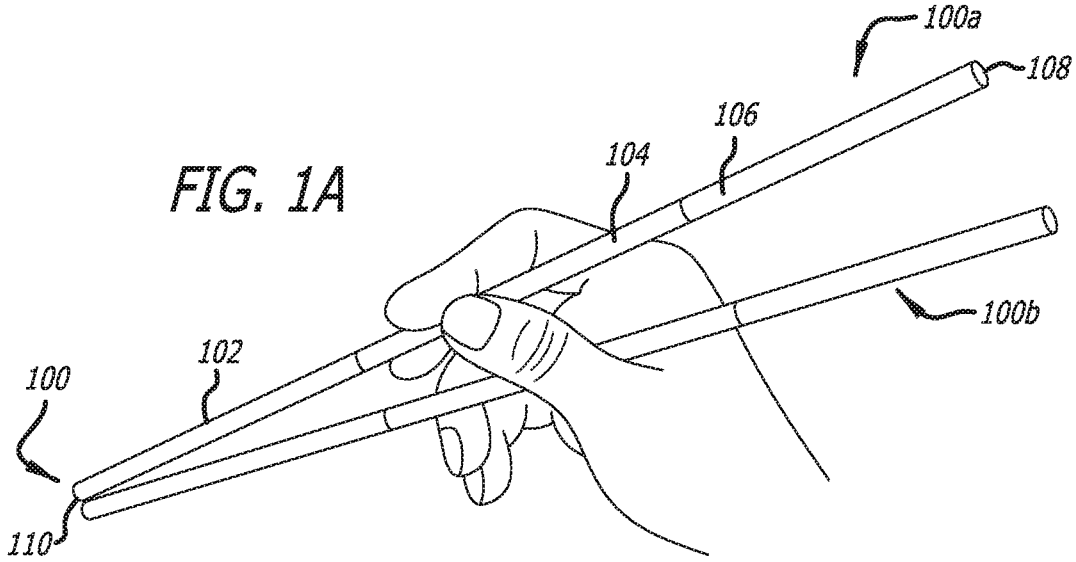
FIG. 1A is a top, front, right side perspective view of a first embodiment of foldable reusable chopsticks in an extended configuration in accordance with the present invention, being held by a user's hand in an exemplary eating position.
Figure 1B:
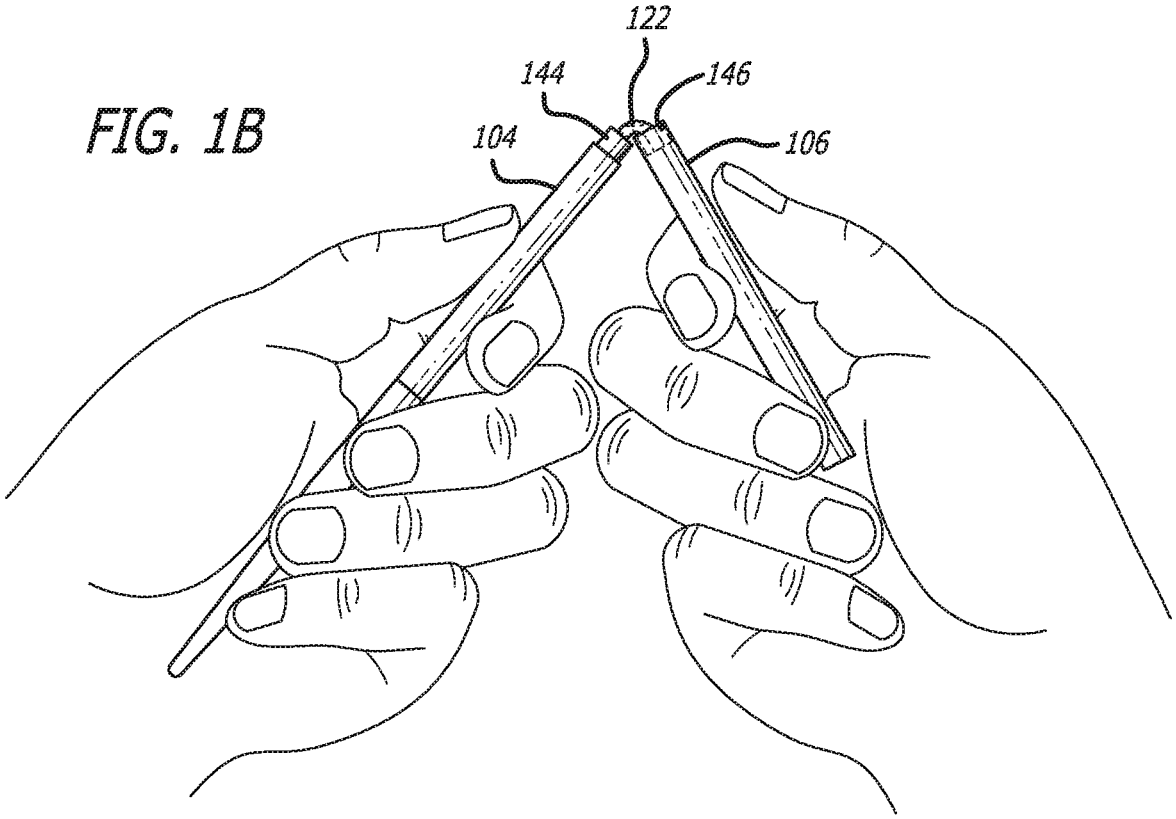
FIG. 1B is a side elevational view of one of the chopsticks of FIG. 1A, being folded by a user's hands.

Referring to FIG. 1A, a pair of chopsticks 100 in accordance with a preferred embodiment of the present invention is shown held in a hand of a user. Pair of chopsticks 100 include a first chopstick 100*a* and a second chopstick 100*b*. Each of chopsticks 100*a* and 100*b* are identical such that only chopstick 100*a* is being described in detail herein, it being understood that such descriptions of chopstick 100*a* equally apply to chopstick 100*b*.

Chopstick 100*a* preferably includes a front segment 102, a middle segment 104, and a rear segment 106. Chopstick 100*a* has a trailing end 108 and a tip 110 opposite trailing end 108 and a central longitudinal axis (CLA) passing through end 108 and tip 110. Each of segments 102, 104, 106 is configured to be coupled to at least another one of segments 102, 104, 106, respectively, when positioned adjacent to one another along the central longitudinal axis (CLA) to form chopstick 100*a*. Segments 102, 104, 106 may be solid or at least in part hollow and are preferably sufficiently rigid to form an outer "shell" in the form of a chopstick 100*a* when assembled together.

As illustrated in FIGS. 1B-1F, chopstick 100*a* preferably includes a first flexible member 120 connected to front segment 102 and middle segment 104 and a second flexible member 122 connected to middle segment 104 and rear segment 106. Flexible member 120 preferably terminates into tabs 124, 125 at opposite ends of flexible member 120. Similarly, flexible member 122 preferably terminates into tabs 126 and 127 at opposite ends of flexible member 122. Preferably, front segment 102 includes a recess 130 and middle segment 104 includes a recess 132 configured to receive tabs 124 and 125, respectively, of flexible member 120. Similarly, middle segment 104 preferably includes a recess 134 and rear segment 106 preferably includes a recess 136 configured to receive tabs 126 and 127, respectively, of flexible member 122. It appreciated that flexible members 120 and 122 can be coupled to segments 102, 106, and 106, respectively, in various ways that would be readily understood by a person of ordinary skill in the art such as, but not limited to, bonding, forming, sonic welding, for example.

As shown in FIGS. 1B-1F, in preferred embodiments of chopstick 100*a*, front segment 102 includes a male end 140; middle segment 104 includes a female end 142 and an opposite male end 144; and rear segment 106 includes a female end 146. It is appreciated that the ends of segments 102, 104, 106 are not limited to a male or female configuration and can be otherwise configured to provide for the interdigitating of the segments. End 140 preferably has reduced dimension portion and forms a shoulder at the intersection of the remainder of segment 102. Reduced dimension portion 140 is correspondingly sized and configured to fit into end 142, with the shoulder of end 140 functioning as a stop. In a preferred embodiment, the cooperative engagement of ends 140, 142 is of close tolerance to form a friction fit between segments 102 and 104 and maintain segments 102 and 104 in a relatively fixed relationship to each other when coupled to prevent unwanted separation during use of chopstick 100*a*. The coupling of segments 104 and 106 and any additional segments operate similar to segments 102 and 104 in the manner just described and is incorporated herein by reference.

As shown in FIGS. 1A-F, in a preferred embodiment chopstick 100*a* has three segments 102,104, 106. However, it is appreciated that chopstick 100*a* can have anywhere from two segments to 6 segments or more depending on the length of the chopsticks desired. It is further appreciated that the size, shape, and number of segments per chopstick is not limited to the examples shown and described herein, and can vary.

Chopstick 100*a* can be configured from an extended configuration to a folded configuration. Chopstick 100*a* is in an extended configuration when at least two of segments 102,104, 106 are coupled together to form rigid chopstick 100*a* with flexible members 120, 122 attached therein.

Flexible members 120, 122 being under sufficient tension within chopstick 100*a* to maintain segments 102,104,106 coupled together in a rigid relationship in the extended configuration.

Figure 1C:
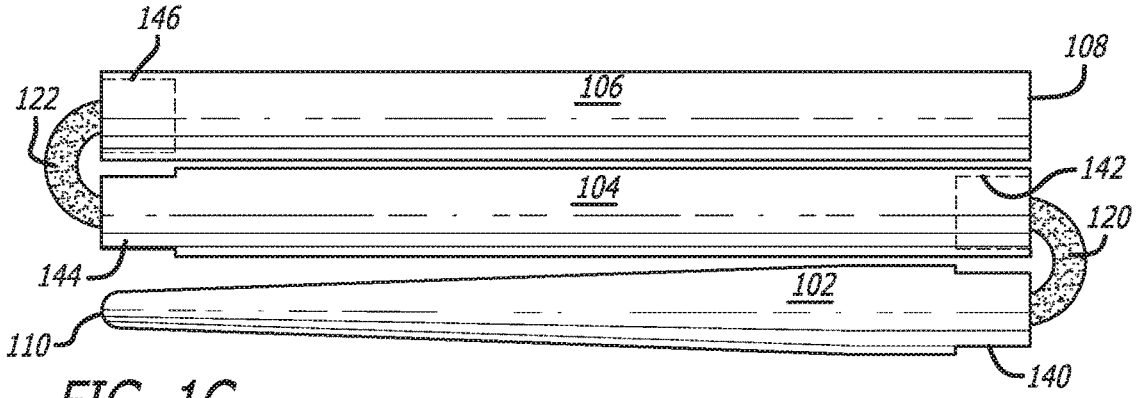
FIG. 1C is a side elevational view of one of the chopsticks of FIG. 1A in a folded configuration.

Chopstick 100*a* is in a folded configuration (FIG. 1C) when at least two of segments 102, 104, 106 are uncoupled from one another and moved apart in an opposite direction along central longitudinal axis (CLA) and stretching flexible members 120, 122, respectively. When in the collapsed configuration, segments 102,104,106 are placed in a generally parallel position to one another, and each flexible member 120 and 122 is folded at least in-part between at least two of segments 102, 104, 106 as shown in FIG. 1C.

In the extended configuration, segments 102, 104, 106 preferably are positioned coaxial to one another along the central longitudinal axis (CLA) of chopstick 100*a*. Flexible members 120, 122 maintain segments 120, 104, 106 under tension in rigid relationship to one another to prevent the unintended collapse of chopstick 100*a* during use. In the folded configuration, segments 102,104,106 preferably are positioned generally parallel to one another as described herein and shown in FIG. 1C.

Segments 102,104,106, as examples, generally can have a circular cross section, an oval cross section, a triangular cross section, or a rectangular cross section transverse to the central longitudinal axis (CLA) or any other configuration, size or shape that is suitable for use as a chopstick. Segments 102, 104, 106 are preferably formed of materials including at least one of stainless steel, titanium, other metals, carbon fiber, composite materials, wood, non-recycled plastics, plant-based plastics, recycled plastics, materials suitable for use with food, and other recyclable and renewable materials. Stainless steel is a preferred material as it is biocompatible, does not rust, recyclable, strong, upcycled stainless steel, ability to be laser engraved in black. Titanium is also biocompatible, does not rust, recyclable, highly strong/weight ratio, upcycled titanium supplier, super strong, ability to have laser engraving in color. The metal segments 102,104,106 can be laser engraved with logos, designs and artwork. Alternatively, any sufficiently rigid material suitable for its intended purpose may be used including plastics and composite materials to form segments 102,104,106 or any other material suitable for use in chopsticks.

Figure 1D:
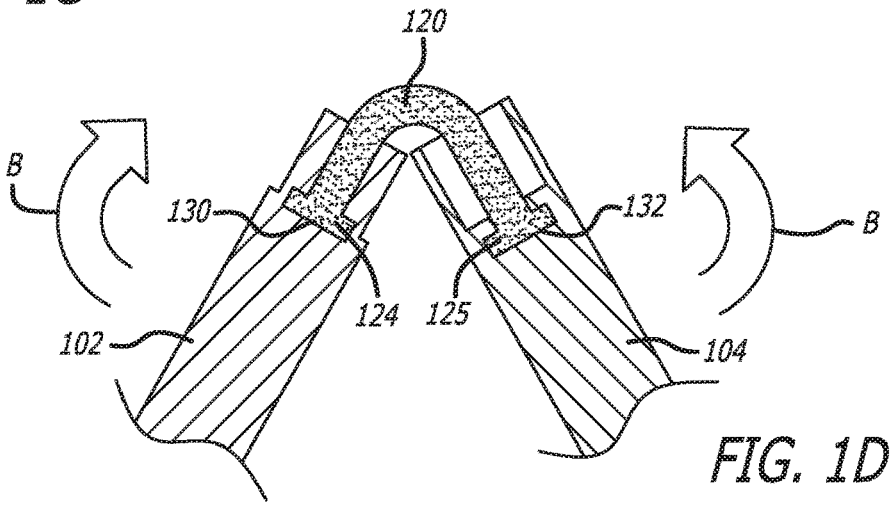
FIG. 1D is a schematic, partial cross-sectional view of one of the chopsticks of FIG. 1A, in a partly folded position.
Figure 1E:
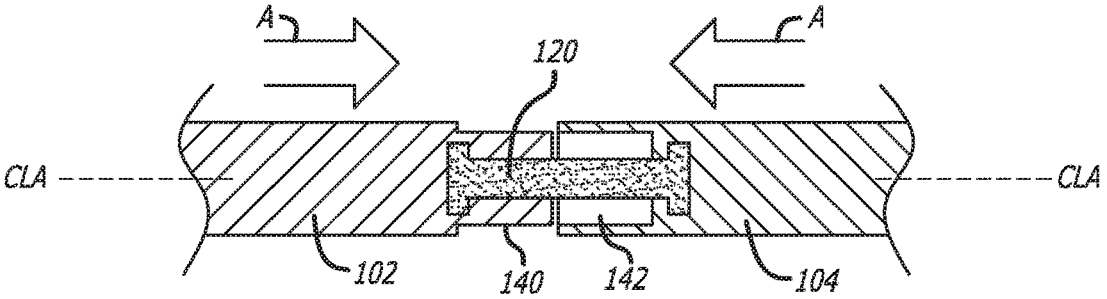
FIG. 1E is a schematic, partial cross-sectional view of one of the chopsticks of FIG. 1A, with the internal flexible member in a stretched position.
Figure 1F:
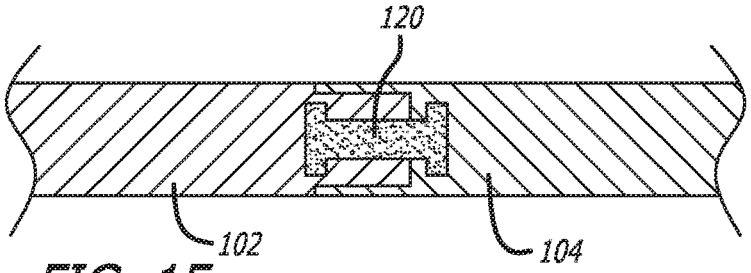
FIG. 1F is a schematic, partial cross-sectional view of one of the chopsticks of FIG. 1A with two segments coupled together with the internal flexible member.

It is preferred that flexible members 120, 122 be sufficiently elastic and flexible to be stretchable (as indicated by arrows A in FIG. 1E) along the central longitudinal axis (CLA) of chopstick 100*a* to maintain segments 102, 104, 106 under tension and be further stretchable to allow separation of segments 102, 104, 106 and folding of flexible members 120, 122, respectively, between two of separated segments 102, 104, 106 (as indicated by arrows B in FIG. 1D). Preferably, flexible members 120, 122 are formed of materials including as examples at least one of plastics, non-recycled plastics, thermoplastic elastomers (TPE), thermoplastic polyurethane (TPU), silicones, natural rubbers including latex, plant-based plastics, and other recyclable and renewable materials.

Figure 1G:
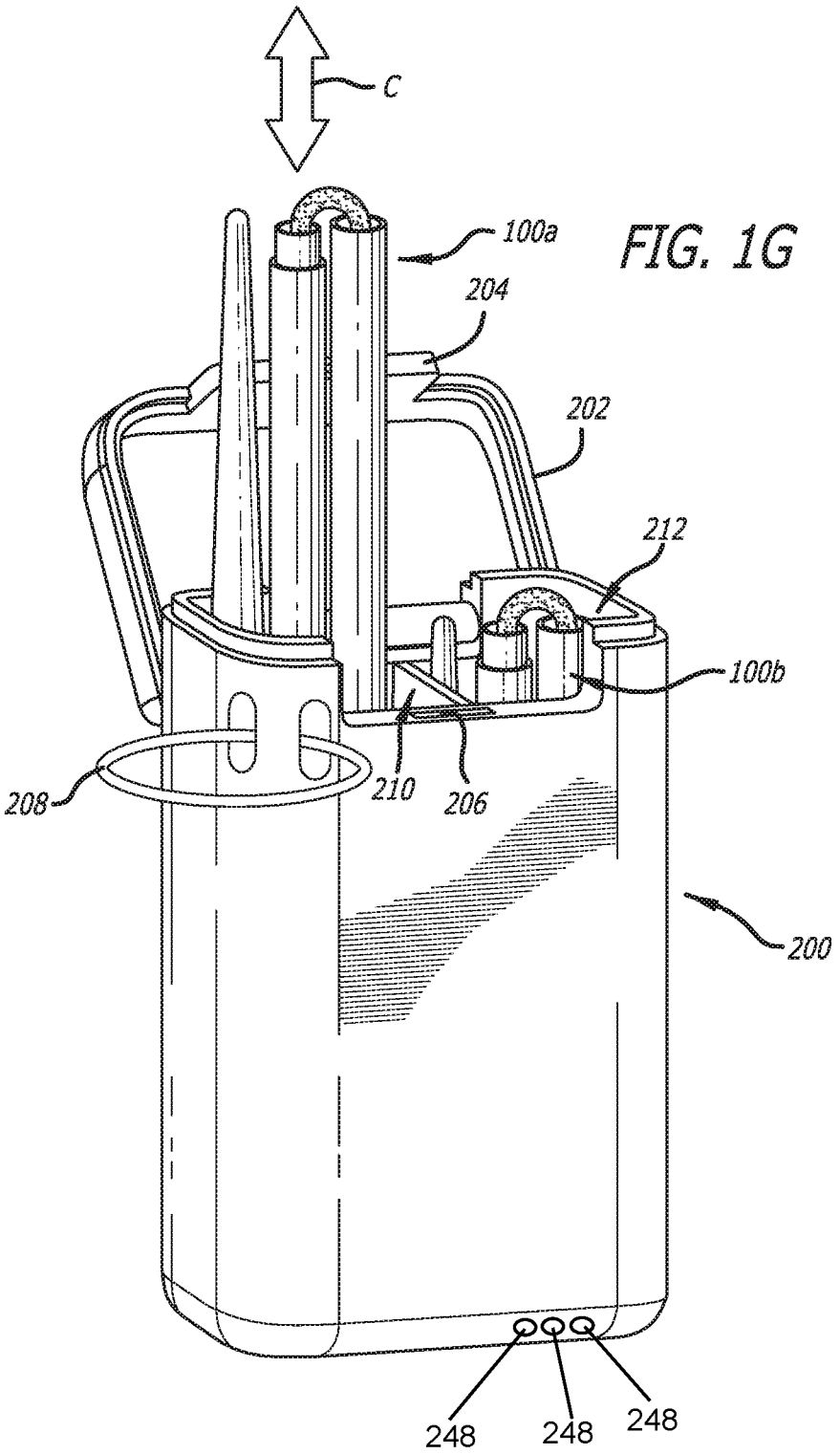
FIG. 1G is a top, front, left side perspective view of a storage case with two pairs of the chopsticks of FIG. 1A stored therein.
Figure 2A:
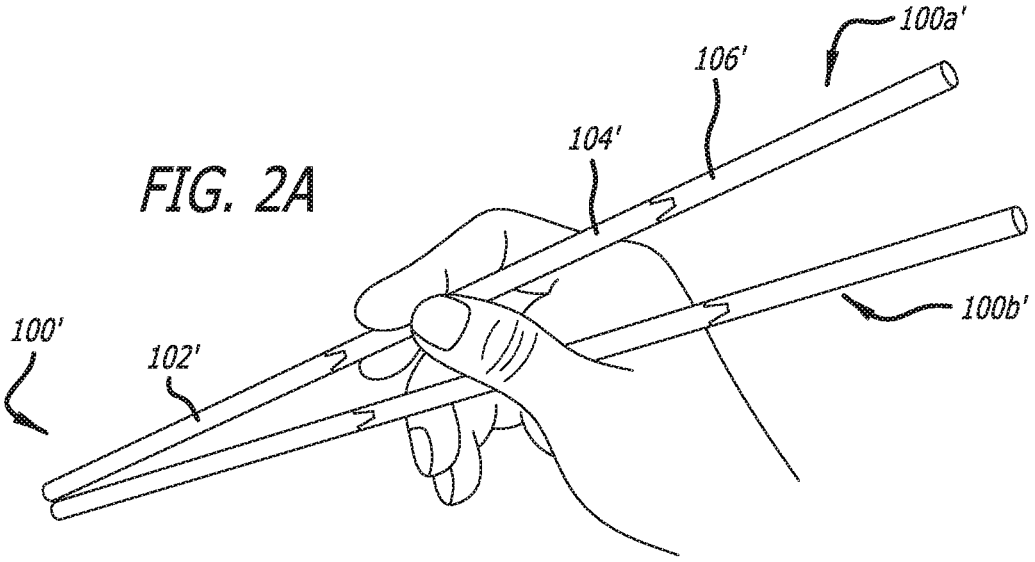
FIG. 2A is a top, front, right side perspective view of a second embodiment of foldable reusable chopsticks in an extended configuration in accordance with the present invention, being held by a user's hand in an exemplary eating position.
Figure 2B:
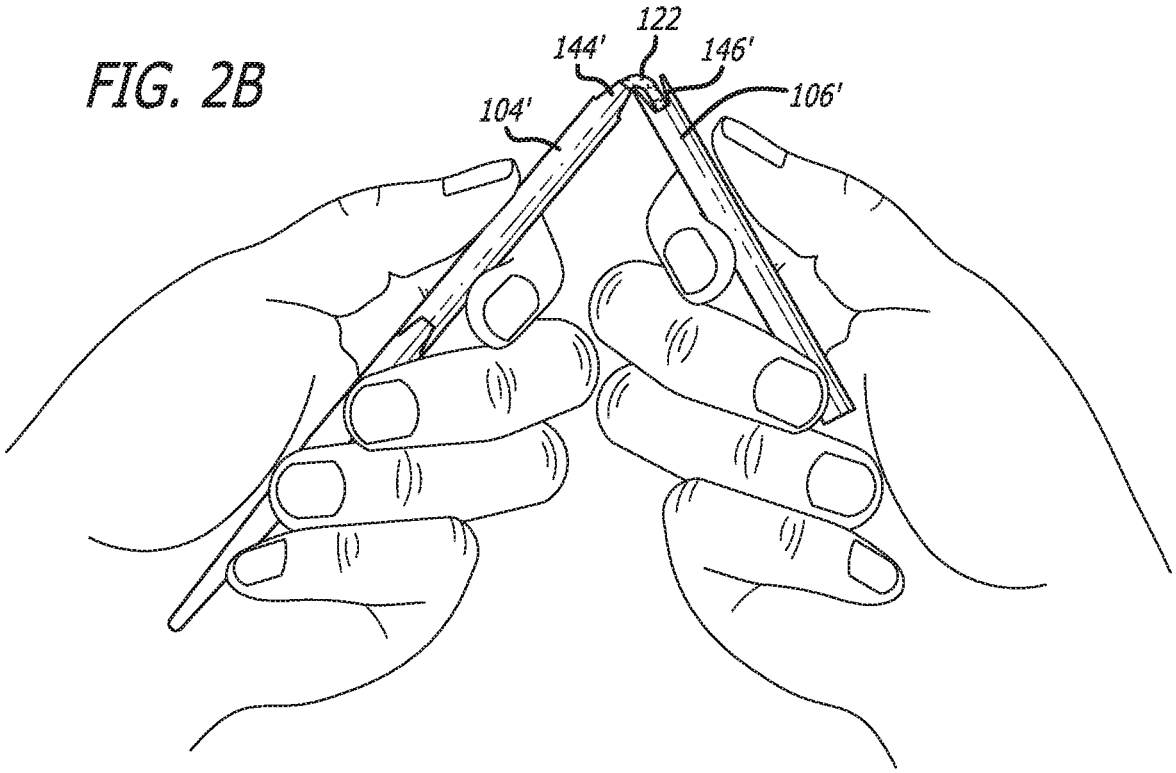
FIG. 2B is a side elevational view of one of the chopsticks of FIG. 2A, being folded by a user's hands.
Figure 2C:
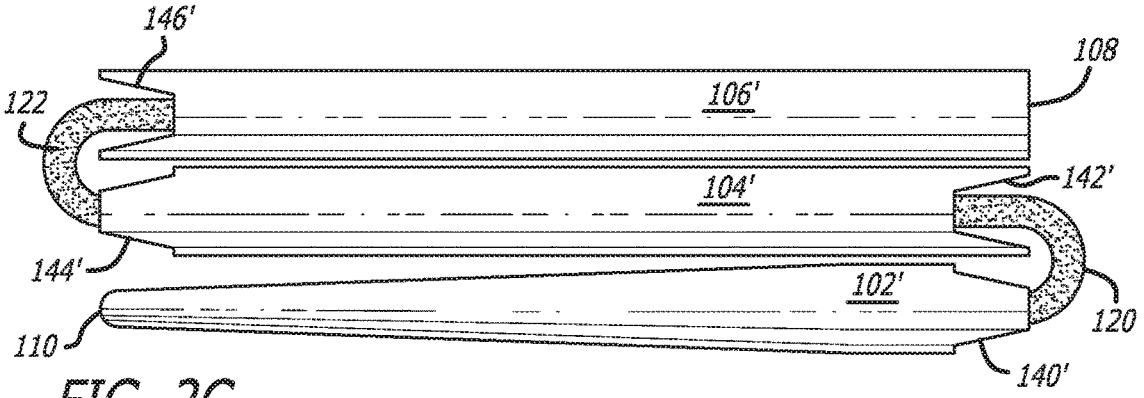
FIG. 2C is a side elevational view of one of the chopsticks of FIG. 2A in a folded configuration.
Figure 2D:
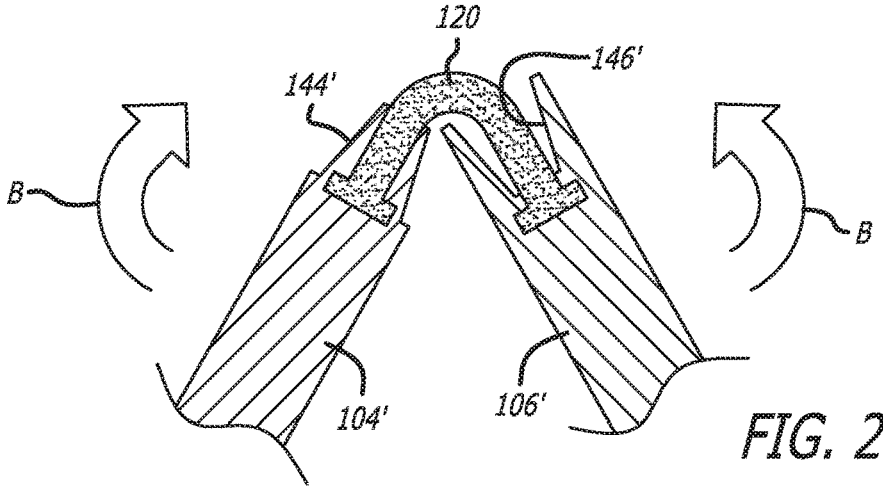
FIG. 2D is a schematic, partial cross-sectional view of one of the chopsticks of FIG. 2A, in a partly folded position.
Figure 2E:
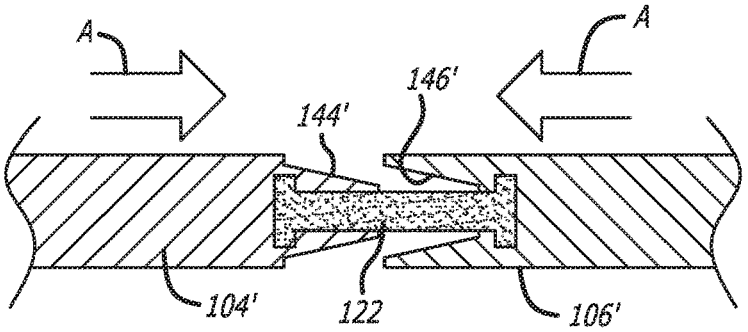
FIG. 2E is a schematic, partial cross-sectional view of one of the chopsticks of FIG. 2A, with the internal flexible member in a stretched position.
Figure 2F:
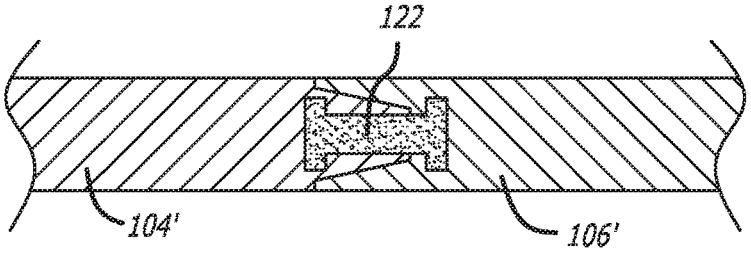
FIG. 2F is a schematic cross-sectional view of one of the chopsticks of FIG. 2A with two segments coupled together with the internal flexible member.

Referring to FIG. 1G, chopstick 100*a* is shown in the folded configuration being inserted in the direction of arrow C in a storage case 200. In the folded configuration, flexible member 120, 122 is shown exposed and folded between segments 102,104,106 such that segments 102,104,106 are stacked and positioned parallel to one another in a compact configuration. In the folded configuration, chopstick 100*a* fits within first storage area 210 of storage case 200 and is held by storage case 200 in the folded configuration. Similarly, chopstick 100*b* fits within second storage area 212 of storage case 200 and is held by storage case 200 in the folded configuration.

Storage areas 210 and 212 can be covered by lid 202 coupled by a hinge to storage case 200 to further protect chopsticks 100*a* and 100*b* and stow them for ease of carrying. Storage case 200 can further include a closure tab 204 and a magnet closure 206 for keeping storage case 200 closed. Storage case 200 can also include a ring 208 such as a split ring for holding keys or attaching to other items. In some examples, the storage case 200 can include at least one vent 248. The at least one vent 248 can permit drainage of any liquid from within the storage case 200. The at least one vent 248 can also permit air drying of the chopsticks 100*a* and 100*b* when contained within the storage case 200.

As shown in FIG. 1G, when chopstick 100*a* is removed from storage case 200, chopstick 100*a* returns to the extended configuration and chopstick 100*a* is ready for use. The elastic nature of flexible members 120 and 122, returning from a stretched state in the folded configuration to a less-stretched state in the extended configuration, functions to essentially automatically extend and reconfigure chopstick 100*a* to the extended configuration. The qualities of the materials of the flexible members 120, 122 permit for repeated cycles stretching from a stretched state to a less-stretched state without significant degradation in elasticity or breakages.

In a preferred embodiment, the storage case can be made from and include materials including for example: recycled materials, bio-plastics, plant-based plastics, woods, metals, composite materials, plant-based composite such as for example a wheat-flaxseed-bamboo based composite and others, recycled ABS plastic injection molded materials, metal hinges, neodymium magnets, and glue. It is appreciated that other materials suitable for the intended purpose of forming chopsticks and a storage case are contemplated to be within the scope of the present invention.

In another preferred embodiment, a chopstick rest is provided supporting the chopsticks when placed on a surface such as a table. The chopstick rest can be built-in to the chopsticks themselves or the storage case or be a separate structure.

FIGS. 2A-2F show another preferred embodiment of a pair of chopsticks 100' showing an alternative configuration of segments 102,104,106. In this preferred embodiment of chopstick 100*a*', front segment 102' includes a male end 140' having an at least in part a V-shape; middle segment 104' includes a female end 142' having an at least in part V-shaped recess for receiving male end 140' and an opposite male end 144' having an at least in part V-shape; and rear segment 106' includes a female end 146' having an at least in part V-shaped recess for receiving male end 144'. The correspondingly-shaped configurations of the interconnecting male and female ends provide for a stable connection of the segments in the extended configuration. The remaining elements of chopstick 100*a*' are similar to the corresponding elements described for chopstick 100*a* and are incorporated herein by reference.

At least a portion V-shaped end 144' preferably has a reduced dimension and forms a shoulder at the intersection of the remainder of segment 104'. V-shaped end 144' is correspondingly sized and configured to fit into V-shaped recess 146', with the shoulder of end 144' functioning as a stop. In a preferred embodiment, the cooperative engagement of ends 144', 146' is of close tolerance to form a friction fit between segments 104' and 106' and maintain segments 104' and 106' in a relatively fixed relationship to each other when coupled to prevent unwanted separation during use of chopstick 100*a*'. The coupling of segments 102' and 104' and any additional segments operate similar to segments 104' and 106' in the manner just described and is incorporated herein by reference.

Figure 3A:
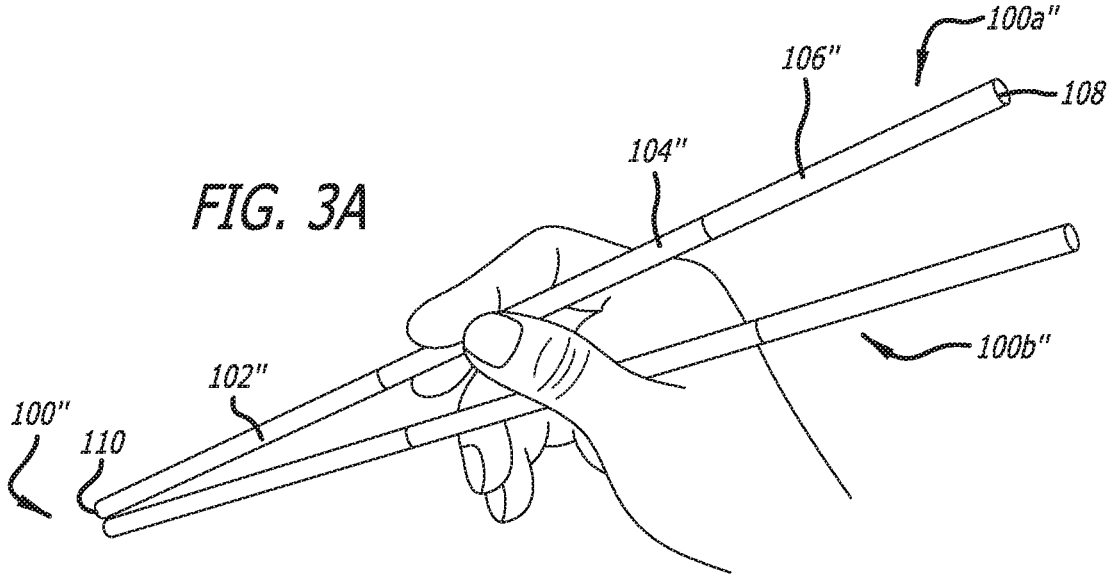
FIG. 3A is a top, front, right side perspective view of a third embodiment of foldable reusable chopsticks in the extended configuration in accordance with the present invention, being held by a user's hand in an exemplary eating position.
Figure 3B:
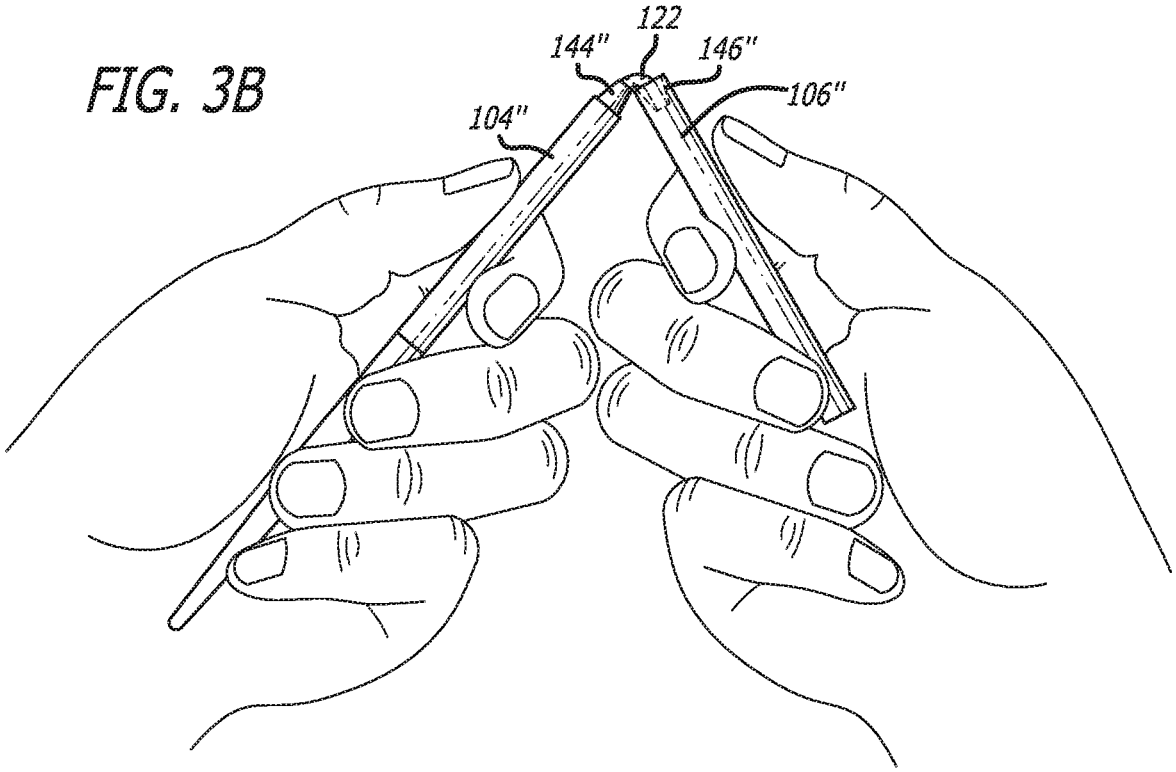
FIG. 3B is a side elevational view of one of the chopsticks of FIG. 3A, being folded by a user's hands.

FIGS. 3A-3B show another preferred embodiment of a pair of chopsticks 100" showing an alternative configuration of segments 102", 104", 106". In this preferred embodiment of chopstick 100*a*", front segment 102" includes a male end 140" having an at least in part conical shape; middle segment 104" includes a female end 142" having an at least in part conical-shaped recess for receiving male end 140" and an opposite male end 144" having an at least in part conical shape; and rear segment 106" includes a female end 146" having an at least in part conical-shaped recess for receiving male end 144". The correspondingly-shaped configurations of the interconnecting male and female ends provide for a stable connection of the segments in the extended configuration. The remaining elements of chopstick 100*a*" are similar to the corresponding elements described for chopstick 100*a* and are incorporated herein by reference.

At least a portion conical-shaped end 144" preferably has a reduced dimension and forms a shoulder at the intersection of the remainder of segment 104". Conical-shaped end 144" is correspondingly sized and configured to fit into conical-shaped recess 146", with the shoulder of end 144" functioning as a stop. In a preferred embodiment, the cooperative engagement of ends 144", 146" is of close tolerance to form a friction fit between segments 104" and 106" and maintain segments 104" and 106" in a relatively fixed relationship to each other when coupled to prevent unwanted separation during use of chopstick 100*a*". The coupling of segments 102" and 104" and any additional segments operate similar to segments 104' and 106' in the manner just described and is incorporated herein by reference.

It should be understood that aspects of the embodiments herein generally may be interchanged in whole or in part. The disclosure further includes the individual parts and/or combinations/subassemblies, methods of making the parts, methods of assembling the parts and methods of using the chopsticks and the storage case.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the broad scope of the following claims.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A reusable chopstick foldable for storage, said chopstick comprising:

a rigid external structure formed of a plurality of segments, said external structure having a proximal end, an opposite distal end, and a central longitudinal axis passing through said ends, each segment of said plurality of segments configured to be coupled to at least another segment of said plurality of segments when positioned adjacent to one another along the central longitudinal axis to form said external structure; and at least one flexible internal member having a proximal end and an opposite distal end, said flexible internal member being formed of an elastic material, said flexible internal member being positioned within said external structure with said proximal end coupled to a first segment of said plurality of segments and said distal end of said flexible internal member coupled to a second segment of said plurality of segments, wherein said chopstick is in an extended configuration when at least said first segment and said second segment of said plurality of segments are coupled together to form said rigid external structure with said flexible internal member therein, said flexible internal member being under tension within said external structure across a juncture of said first segment and said second segment of said plurality of segments to maintain said first and second segments coupled together, wherein said chopstick is in a folded configuration when at least said first segment and said second segment of said plurality of segments are uncoupled and moved apart along said flexible internal member by stretching said flexible internal member and folding said flexible internal member between said first and second segments.

2. The chopstick of claim 1, wherein in the extended configuration said segments are positioned coaxial to one another along the central longitudinal axis, and in the folded configuration said segments are generally parallel to one another.

3. The chopstick of claim 1, wherein said first segment of said plurality of segments includes a first end and a second end and said second segment of said plurality of segments includes a first end and a second end, said first end of said first segment being configured to cooperatively engage said second end of said second segment.

4. The chopstick of claim 1, wherein said first segment of said plurality of segments includes a first end and a second end and said second segment of said plurality of segments includes a first end and a second end, said first end of said first segment being configured to interdigitate with said second end of said second segment.

5. The chopstick of claim 1, wherein said first segment of said plurality of segments includes a first end and a second end and said second segment of said plurality of segments includes a first end and a second end, said first end of said first segment being configured to form a friction fit with said second end of said second segment.

6. The chopstick of claim 1, wherein each of said segments is configured to be coupled to at least a third segment of said plurality of segments.

7. The chopstick of claim 1, wherein said chopstick is moved from said extended configuration to said folded configuration when at least said first segment and said second segment of said plurality of segments are uncoupled and moved apart along the central longitudinal axis of said flexible member by stretching said flexible member.

8. The chopstick of claim 1, wherein said chopstick is moved from said folded configuration to said extended configuration when at least said first segment and said second segment of said plurality of segments are moved together and coupled to one another along the central longitudinal axis of said flexible member.

9. The chopstick of claim 1, wherein each segment of said plurality of segments has one of a circular cross section, an oval cross section, or a rectangular cross section.

10. The chopstick of claim 1, wherein each segment of said plurality of segments is formed of materials including at least one of metal, stainless steel, titanium, wood, carbon fiber, composite materials, non-recycled plastics, plant-based plastics, recyclable materials, materials suitable for use with food, and renewable materials.

11. The chopstick of claim 1, wherein said flexible member is formed of materials including at least one of plastics, non-recycled plastics, thermoplastic elastomers (TPE), thermoplastic polyurethane (TPU), silicones, natural rubbers including latex, plant-based plastics, materials suitable for use with food, and renewable material.

12. The chopstick of claim 1, wherein said proximal end of said flexible member is fixedly coupled to said first segment of said plurality of segments and said distal end of said flexible member is fixedly coupled to said second segment of said plurality of segments.

13. A system for using eating utensils, the system comprising:

a reusable chopstick foldable for storage, the chopstick comprising:

an external structure formed of a plurality of segments, said external structure having a proximal end, an opposite distal end, and a central longitudinal axis passing through said ends, each segment of said plurality of segments configured to be coupled to at least another segment of said plurality of segments when adjacent to one another along the central longitudinal axis to form said external structure; and at least a flexible member having a proximal end, and an opposite distal end, said flexible member being formed of an elastic material, said flexible member being positioned within said external structure with said proximal end coupled to a first segment of said plurality of segments and said distal end of said flexible member coupled to a second segment of said plurality of segments; and a storage case configured to contain said chopstick, wherein said chopstick is in an extended configuration when at least said first segment and said second segment of said plurality of segments are coupled together to form said rigid external structure with said flexible member therein, said flexible member being under tension within said external structure across a juncture of said first segment and said second segment of said plurality of segments to maintain said first and second segments coupled together, wherein said chopstick is in a folded configuration when at least said first segment and second segment of said plurality of segments are uncoupled and moved apart along said flexible member by stretching said flexible member and folding said flexible member between said first segment and said second segment of said plurality of segments, wherein said storage case contains said chopstick in said folded configuration.

14. The system of claim 13, wherein said storage case includes at least one vent to permit at least one of drainage of any liquid from within said storage case and air drying of said chopstick when contained within the storage case.

15. The system of claim 13, wherein said storage case has a first storage area for holding the chopstick in a folded configuration and a second storage area for holding a second chopstick in the folded configuration.

16. The system of claim 13, wherein when said chopstick is in the extended configuration at least said first segment and said second segment of said plurality of segments are positioned coaxial to one another along the central longitudinal axis, and in the folded configuration at least said first segment and said second segment of said plurality of segments are generally parallel to one another.

17. The system of claim 13, wherein said first segment of said plurality of segments of said chopstick includes a first end and a second end and said second segment of said plurality of segments of said chopstick includes a first end and a second end, said first end of said first segment being configured to cooperatively engage said second end of said second segment.

18. The system of claim 13, wherein said first segment of said plurality of segments of said chopstick includes a first end and a second end and said second segment of said plurality of segments of said chopstick includes a first end and a second end, said first end of said first segment being configured to interdigitate with said second end of said second segment.

19. The system of claim 13, wherein said chopstick is moved from said extended configuration to said folded configuration when at least said first segment and said second segment of said plurality of segments are uncoupled and moved apart along the central longitudinal axis of said flexible member by stretching said flexible member.

20. The system of claim 13, wherein said chopstick is moved from said folded configuration to said extended configuration when at least said first segment and said second segment of said plurality of segments are moved together and coupled to one another along the central longitudinal axis of said flexible member.

21. The system of claim 13, wherein said proximal end of said flexible member is fixedly coupled to said first segment of said plurality of segments and said distal end of said flexible member is fixedly coupled to said second segment of said plurality of segments.

22. A method of using a foldable and reusable chopstick, the method comprising:

providing the chopstick having:

an external structure formed of a plurality of segments, said external structure having a proximal end, an opposite distal end, and a central longitudinal axis passing through said ends, each segment of said plurality of segments is configured to be coupled to at least another segment of said plurality of segments when adjacent to one another along the central longitudinal axis to form said external structure; and at least one flexible member having a proximal end and an opposite distal end, said flexible member being formed of an elastic material, said flexible member being positioned within said external structure with said proximal end coupled to a first segment of said plurality of segments and said distal end of said flexible internal member coupled to a second segment of said plurality of segments;

extending said chopstick in an extended configuration when at least said first segment of said plurality of segments and said second segment of said plurality of segments are coupled together to form said external structure with said flexible member therein, said flexible internal member being under tension within said external structure across a juncture of said first segment of said plurality of segments and said second segment of said plurality of segments to maintain said first and second segments coupled together; and folding said chopstick in a folded configuration when at least said first segment of said plurality of segments and said second segment of said plurality of segments are uncoupled and moved apart along said flexible member by stretching said flexible member and folding said flexible member between said first and second segments.

23. The method of claim 22, wherein said proximal end of said flexible member is fixedly coupled to said first segment of said plurality of segments and said distal end of said flexible member is fixedly coupled to said second segment of said plurality of segments.

* * * * *